United States Patent [19]

Goldenberg

[11] Patent Number: 4,646,643

[45] Date of Patent: Mar. 3, 1987

[54] CARTRIDGE ASSEMBLY FOR A PROJECTABLE LOAD

[75] Inventor: Joseph M. Goldenberg, Upper Saddle River, N.J.

[73] Assignee: Proll Molding Co., Inc., Bloomfield, N.J.

[21] Appl. No.: 637,299

[22] Filed: Aug. 3, 1984

[51] Int. Cl.[4] ..... F42B 5/26

[52] U.S. Cl. ..... 102/464; 102/430

[58] Field of Search ..... 102/430, 448–463, 102/464, 465, 466

[56] References Cited

U.S. PATENT DOCUMENTS

| | | | |
|---|---|---|---|
| 630,477 | 8/1899 | Behr . | |
| 1,306,407 | 6/1919 | Davidson . | |
| 2,459,687 | 1/1949 | Decker | 102/37.7 |
| 3,044,360 | 7/1962 | Stefan et al. | 89/1 |
| 3,111,899 | 11/1963 | Tiedmann | 102/37.6 |
| 3,131,498 | 5/1964 | Coulter | 42/1 |
| 3,275,829 | 9/1976 | McLune et al. | 250/85 |
| 3,369,534 | 2/1968 | Crosmann | 102/430 |
| 3,460,507 | 8/1969 | Little et al. | 116/124 |
| 3,479,954 | 11/1969 | Bolieau | 102/37.8 |
| 3,575,111 | 4/1971 | Richardson | 102/37.8 |
| 3,612,857 | 10/1971 | Beatty et al. | 240/2.25 |
| 3,625,152 | 12/1971 | Schneider | 102/73 |
| 3,670,651 | 6/1972 | Mertens | 102/452 |
| 3,674,174 | 7/1972 | Crewe | 221/87 |
| 3,712,224 | 1/1973 | Hanzel | 102/37.6 |
| 3,741,122 | 6/1973 | Miller | 102/37.8 |
| 3,820,462 | 6/1974 | Jackson, Jr. | 102/35.6 |
| 3,851,588 | 12/1974 | Taylor | 102/37.8 |
| 3,855,930 | 12/1974 | Mulich et al. | 102/34.4 |
| 3,940,605 | 2/1976 | Gerber | 240/2.25 |
| 3,964,393 | 6/1976 | Foote et al. | 102/37.6 |
| 4,167,904 | 9/1979 | Ferri | 102/452 |
| 4,171,669 | 10/1979 | Allen | 102/37.6 |
| 4,176,606 | 12/1979 | King et al. | 102/37.4 |
| 4,222,306 | 10/1980 | Maury | 89/1 L |
| 4,380,957 | 4/1983 | Makainai | 102/202.1 |
| 4,389,939 | 6/1983 | Ofuji | 102/458 |
| 4,478,150 | 10/1984 | Sayler et al. | 102/430 |

FOREIGN PATENT DOCUMENTS

| | | | |
|---|---|---|---|
| 563817 | 6/1957 | Italy | 102/430 |
| 2075155 | 11/1981 | United Kingdom | 102/430 |

*Primary Examiner*—Deborah L. Kyle
*Assistant Examiner*—T. J. Wallen
*Attorney, Agent, or Firm*—Lerner, David, Littenberg, Krumholz & Mentlik

[57] ABSTRACT

Unitary cartridge of plastic material for discharging a pyrotechnic mixture, smoke flare, chaff round, and the like is disclosed. A slidable piston is contained within a hollow casing forming the cartridge to engage with a portion of the casing to provide an internal integral seal for sealing a replaceable impulse cartridge and/or blank plug therein. A moisture proof seal is thereby maintained when the cartridge is armed by the insertion of an impulse cartridge or downloaded by the insertion of a blank plug. To facilitate the assembly of the cartridge, a rupturable closed end is provided with an internal lip adapted for engagement with an end plug to facilitate its alignment and positioning therein.

21 Claims, 4 Drawing Figures

CARTRIDGE ASSEMBLY FOR A PROJECTABLE LOAD

BACKGROUND OF THE INVENTION

The present invention relates in general to a cartridge assembly, and more particularly, to a cartridge assembly of unitary construction adapted for projecting loads therefrom such as pyrotechnic flares, smoke flares, chaff rounds, and the like, which cartridge assembly includes an internally formed integral seal arranged at one end thereof for alternatively sealing a removable impulse cartridge and protective plug therein to prevent moisture contamination of the load, and including a rupturable closure arranged at the other end thereof through which the load is projected and having means to facilitate the alignment and insertion of the rupturable closure therein and provide a moisture proof seal.

Anti-aircraft missiles having guidance systems are commonly designed to home in on infrared energy generated by a turbojet engine tailpipe or exhaust plume. Such missiles are sensitive to infrared energy in precise preselected wavelengths which are generated by the hot tailpipe or exhaust plume. These missiles are commonly counter measured by launching a high temperature source such as a pyrotechnic flare from the aircraft which will generate infrared energy in that portion of the spectrum to which the missile is sensitive. The missile, then breaks its lock from the aircraft and locks in on the decoy infrared source and permits the aircraft to escape.

Known pyrotechnic flare cases are generally constructed from a metallic billet drawn into the form of a hollow casing which receives an internal slidable piston arranged adjacent to a pyrotechnic mixture. An impulse cartridge is inserted within an open end of the casing adjacent the piston and ignited to propel the pyrotechnic mixture out of the casing by movement of the piston due to the resulting build-up of gas pressure therebehind. It is well-known that these pyrotechnic mixtures must be sealed from contamination from moisture which could react with the mixture to result in reduced or unsatisfactory performance. In addition, it is also well-known that the pyrotechnic flare must be rendered safe during storage by removal of the impulse cartridge and the insertion of a blank plug to seal the open end of the casing. To this end, the open end of the metallic casing of the known pyrotechnic flares have been individually machined to include a circumscribing groove adapted to receive an O-ring as a seal member for either the impulse cartridge or blank plug.

The manufacture of these pyrotechnic flare cases from metallic billets drawn to form a hollow casing therefrom, and machined at one end to provide a groove for receiving an O-ring, has been both expensive and labor intensive. In order to achieve a more economic advantage in the construction of these pyrotechnic flare cases, the prior art has recognized the advantage of molding the hollow casing from plastic material. However, the molding of a unitary hollow casing from plastic material to include an internal circumscribing groove for retaining an O-ring therein requires the use of expensive molds having movable pins and parts. To avoid the necessity of constructing expensive and complicated molds, the construction of a multiple component plastic casing has been fabricated. However, such casing requires the joining of the plastic components along parting lines which are a source of failure of the pyrotechnic flare due to cracking, poor bonding, penetration by moisture, as well as increasing the manufacturing costs. In order to overcome these disadvantages resulting from the construction of a multi-component plastic casing, the prior art has constructed the open end of the casing to include a circumscribing planar surface having a plastic flashing adapted to provide an interference seal with the impulse cartridge and/or blank plug. At best, this interference fit is not capable of reproducibility or reliability. Moreover, this interference fit is often eliminated due to temperature changes and/or the repeated insertion of either the impulse cartridge or blank plug. For example, the blank plug, which is tapered, would often stretch out the plastic flashing which would retain its new dimension thereby preventing it from affecting a seal with the impulse cartridge.

In addition to providing a seal for the impulse cartridge or blank plug at one end of the plastic casing, it is required to provide a moisture sealed rupturable closed end through which the pyrotechnic mixture will be ejected during use of the pyrotechnic flare. The known pyrotechnic flare with aluminum case has used a plastic rectangular end cap which was manually inserted into its rectangular opening formed at one end of the hollow casing. Using an O-ring to provide the seal, the end cap, after being inserted into the casing to its proper depth, was locked in place by two plastic pins inserted through holes in the metal case and was sealed using an appropriate sealant such as Silicone adhesive. The insertion of the plastic pins and sealing operation required labor-intensive effort. Another disadvantage of the existing assembly is that the O-ring used in the end cap must be assembled by passing the holes at the same level that the seal will function. Potential damage to the O-ring caused by burrs and sharp edges often results in sealing failure.

SUMMARY OF THE INVENTION

It is broadly an object of the present invention to provide a cartridge assembly for projecting a load therefrom which avoids or overcomes one or more of the foregoing disadvantages resulting from the use of the above-mentioned prior art pyrotechnic flare case assembly constructions, and which fulfills the specific requirements of such a cartridge assembly for projecting various materials therefrom, such as pyrotechnic items including pyrotechnic flares, smoke flares, chaff rounds, and the like. Specifically, it is within the contemplation of one aspect of the present invention to provide a cartridge assembly for projecting a load therefrom which is constructed of a unitary plastic hollow casing having an internally formed integral seal adapted for repeated sealing with an impulse cartridge and/or blank plug as necessitated during use and the downloading thereof.

It is another object of the present invention to provide a cartridge assembly for projecting a load therefrom which is waterproof, easy to assemble, and of low cost construction, and avoids the use of complicated and expensive molds and/or metal processing machinery.

It is another object of the present invention to provide a cartridge assembly for projecting a load therefrom which provides a moisture proof seal whose integrity remains unaltered during changes in ambient temperature.

It is another object of the present invention to provide a cartridge assembly for housing loads for projecting therefrom having an end cap construction adapted to facilitate its alignment and insertion within the casing of the cartridge to ensure the integrity of the seal formed thereat and the operation of the cartridge assembly during the projection of a load therefrom.

In accordance with one embodiment of the present invention, there is provided a cartridge assembly for projecting a load therefrom. The cartridge assembly is constructed of a hollow casing having an open end, a piston movably positioned within the casing, a seal provided adjacent the open end by a portion of the piston and a portion of the casing, and projecting means for projecting the load from the casing by movement of the piston, the projecting means being removably sealed within the open end by engagement with the seal.

Further in accordance with the above embodiment, that portion of the casing comprises a shoulder defining an opening within the casing for receiving the projecting means, and that portion of the piston comprises a ridge circumscribing the piston and arranged in engagement with the shoulder.

In accordance with another embodiment of the present invention, there is provided a cartridge assembly for projecting a load therefrom. The cartridge assembly is constructed of a hollow casing having an open end, a closure inserted within the open end, stop means provided within the casing adjacent the open end for limiting the extent of insertion of the closure within the casing by engagement of the closure therewith, and projecting means provided within the casing for projecting a load therefrom.

BRIEF DESCRIPTION OF THE DRAWINGS

The above description, as well as further objects, features and advantages of the present invention will be more fully understood by reference to the following detailed description of the presently preferred, but nonetheless illustrative, cartridge assembly for projecting a load therefrom in accordance with the present invention, when taken in conjunction with the accompanying drawings, wherein.

DETAILED DESCRIPTION

Figure 1:
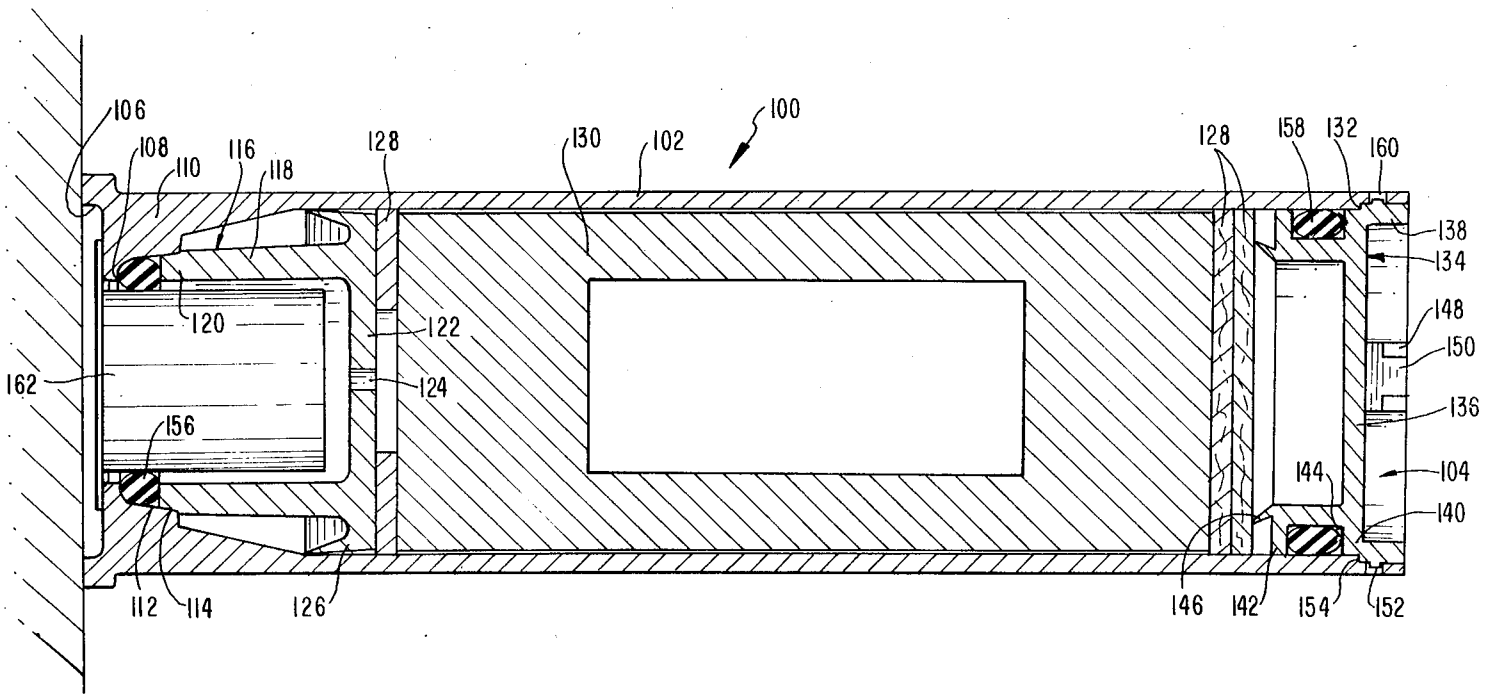
FIG. 1 is a cross-sectional view of the cartridge assembly in accordance with the present invention for projecting a load therefrom showing its unitary construction from plastic material to essentially include a hollow casing, a slidable piston, a rupturable end cap, and a load, wherein the piston engages with a portion of the hollow casing adjacent the open end to provide a seal thereat.

Turning now to the drawings, wherein like reference numerals represent like elements, there is shown in FIG. 1 a cross-sectional view of a cartridge assembly of unitary construction adapted for projecting loads therefrom such as IR pyrotechnic flares, smoke flares, chaff rounds, and the like, and generally designated by reference numeral 100. The cartridge assembly 100 is constructed of a molded one-piece, hollow casing 102 from plastic material such as nylon, fiberglass, polycarbonate, ABS, PBT, and preferably from a mixture of nylon and fiberglass. The casing 102 has a generally rectangular cross-section along its length, and provided with a rectangular opening 104 at one end and a recessed wall 106 arranged normal to the longitudinal axis of the casing at the other end thereof. Extending through the wall 106 along the longitudinal axis of the casing 102 is a circular opening 108 defined by a shoulder 110 unitarily formed from a portion of the casing and extending inwardly thereof. The shoulder 110 is provided with a smooth sealing surface 112 and a projecting step 114.

Figure 2:
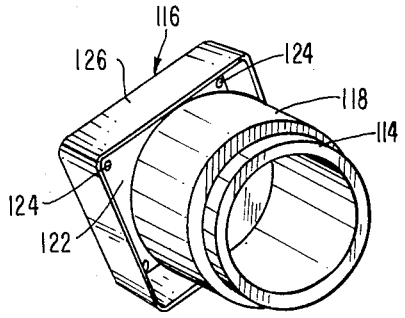
FIG. 2 is a perspective view of the piston as shown in FIG. 1 having a ridge at one end thereof adapted for engaging with a shoulder formed from the hollow casing at the open end thereof.

A movable piston 116 is arranged slidable within the hollow casing 102 adjacent the circular opening 108 defined by the shoulder 110. As shown in FIGS. 1 and 2, the piston 116 is constructed of a hollow cylindrical member 118, having a ridge 120 provided at its free end and extending normal to a planar base 122 provided with a plurality of openings 124. A wall 126 is provided circumscribing the base 122 and extending along the longitudinal axis of the piston 116 towards the ridge 120. In addition to the foregoing, the cartridge assembly 100 is provided with a plurality of felt spacers 128 and a load 130. As previously described, the load 130 can include pyrotechnic flares, smoke flares, chaff rounds, and the like.

Figure 3:
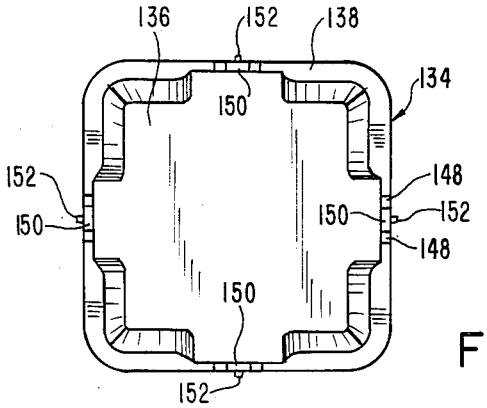
FIG. 3 is a top plan view of the end cap as shown in FIG. 1 having a plurality of resilient tabs on either side thereof.
Figure 4:
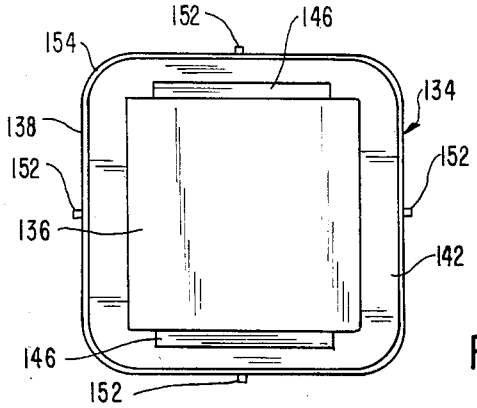
FIG. 4 is a bottom plan view of the end cap as shown in FIG. 3 having resilient spacing means extending outwardly from the bottom surface thereof.

Referring now to the rectangular opening 104, the opening is provided with a lip 132 circumscribing the interior surface of the casing 102 at a predetermined distance from the opening. The lip 132 is provided by a reduction in the thickness of the wall forming the hollow casing 102. Provided within the rectangular opening 104 is a rupturable end cap 134. As shown in FIGS. 1, 3, and 4, the end cap 134 is of rectangular shape constructed of a base 136 having a circumscribing wall 138, and a pair of spaced apart protrusions 140, 142 defining a recess 144 circumscribing the perimeter of the end cap 134. Extending outwardly from the protrusion 142 are a pair of resilient tangs 146. Provided along each side of the wall 138 are a pair of cut-outs 148 defining a resilient tab 150 therebetween having an outwardly extending projection 152. As shown, the cross-sectional dimension of the protrusions 140, 142, is slightly smaller then the cross-sectional dimension of the wall 138 to provide a circumscribing lip 154. The piston 116 and end cap 134 can be constructed of the same plastic material used in the construction of the hollow casing 102, as well as being molded in a similar manner.

The assembling of the cartridge assembly 100, and its use, will now be described with reference to FIG. 1. As shown, an O-ring 156 is provided within the circular opening 108 defined by the shoulder 112. The piston 116 is positioned within the hollow casing 102, such that the ridge 120 engages the step 114 of the shoulder, so as to retain the O-ring 156 within the circular opening 108, providing for a moisture proof seal when an impulse cartridge or a protective plug is inserted therein. The wall 126 circumscribing the base 122 of the piston 116 is arranged in interference sliding contact with the inner surface of the hollow casing 102 to provide a gas seal thereat. Overlying the base 122 of the piston 116 is a first felt spacer 128, next followed by the load 130. Adjacent the other end of the load 130 is a second and a third felt spacer 128, next followed by the end cap 134.

The insertion of the end cap 134 within the rectangular opening 104 is facilitated by the fact that the cross-sectional dimension of the protrusions 140, 142 is slightly smaller than the cross-sectional inside dimension of the hollow casing 102. The end cap 134 is sealed within the hollow casing 102 by means of an O-ring 158 provided within the recess 144. The inward movement of the end cap 134 within the hollow casing 102 along its longitudinal axis is limited by the engagement of the lip 154 with the lip 132 provided by the reduction in the thickness of the wall forming the hollow casing. The insertion of the end cap 134 within the hollow casing 102 is facilitated by the reduction in the thickness of the wall forming the open end of the hollow casing 102. This thickness reduction minimizes the potential damage to the O-ring 158. The end cap is locked in sealing engagement within the rectangular opening 104 to provide a rupturable closed end by the projections 152 on the tabs 150 engaging corresponding openings 160 provided within the wall of the hollow casing 102. The tangs 146, by projecting inwardly of the hollow casing 102, are adapted to act as spacers to accommodate slight dimensional differences in the longitudinal lengths of various loads 130.

The cartridge assembly 100 is armed by insertion of an impulse cartridge 162 through the circular opening 108 and into the hollow of the piston 116 formed by the hollow cylindrical member 118. The impulse cartridge 162 engages the O-ring 156 and compresses the O-ring against the sealing surface 112 of the shoulder 110 and the ridge 120 of the piston 116 to provide a seal thereat. The seal formed by the O-ring 156 prevents moisture from entering the hollow casing 102 through the circular opening 108 to prevent moisture contamination of the load 130. Likewise, the O-ring 158 prevents moisture from entering the hollow casing 102 through the rectangular opening 104 to prevent moisture contamination of the load 130. The cartridge assembly 100, of unitary construction, provides a moisture-proof hollow casing 102 to provide for pyrotechnic flares, smoke flares, chaff rounds, and the like.

The projection of a load 130 from the hollow casing 102 is in a conventional manner. That is, upon igniting the impulse cartridge 162, the load 130 is projected out of the hollow casing by movement of the piston 116, due to the resulting build-up of gas pressure therebehind. The load 130 is also ignited by the hot gases from the squip impinging on the flare through the holes 124 provided in the piston 116. The load 130 is projected through the rupturable closed end by forcing the end cap 134 out of its sealed engagement within the rectangular opening 104 by shearing the four projections 152 on the end cap.

As previously described, when the load 130 comprises, for example, a pyrotechnic mixture, it is required that the pyrotechnic mixture be rendered safe during storage by removal of the impulse cartridge 162 and the insertion of a blank plug of the same dimensions to seal the circular opening 108 within the hollow casing 102. In this manner, the blank plug, which is of a shape similar to the impulse cartridge 162, provides a seal with the O-ring 156 to prevent moisture from entering into the hollow casing 102 through the circular opening 108. As a result of this construction of the cartridge assembly 100, an impulse cartridge 162 or blank plug may be repeatedly inserted and withdrawn within the circular opening 108 of the cartridge assembly 100 to, at all times, prevent moisture contamination of the load 130. Regardless of the number of times that the impulse cartridge 162 or blank plug are inserted within the circular opening 108, the O-ring 156 always provides a positive, moisture-proof seal whose integrity remains unaltered during changes in ambient temperature.

The construction of the cartridge assembly 100 renders it moisture proof, easy to assemble, of low-cost construction, and avoids the use of complicated and expensive molds and metal processing machinery. In addition, the rupturable closed end construction of the cartridge assembly 100 is adapted to facilitate the alignment and insertion of the end cap 134 within the hollow casing 102, so as to insure the integrity of the seal formed thereat in the operation of the cartridge assembly during the projection of the load 130 therefrom.

In accordance with the present invention, there has been described a cartridge assembly for projecting a load therefrom. The cartridge assembly is constructed of a hollow casing having open ends, a piston movably positioned within the casing adjacent the open end, a load positioned within the casing between the piston and the rupturable closed end, an impulse cartridge removably inserted within the open end for projecting the load from the casing through the rupturable closed end by movement of the piston away from the open end, a seal provided within the open end for removal by inserting an impulse cartridge therein, the seal provided within the open end in engagement with the projecting means by a portion of the piston cooperating with a portion of the casing.

Although the invention herein has been described with reference to particular embodiments, it is to be understood that these embodiments are merely illustrative of the principles and application of the present invention. It is, therefore, to be understood that numerous modifications may be made in the illustrative embodiments and that other arrangement may be devised without departing from the spirit and scope of the present invention as defined by the appended claims.

What is claimed is:

1. A cartridge assembly for projecting a load therefrom, said cartridge assembly comprising a hollow casing having an open end and a rupturable closed end, a piston movably positioned within said casing, projecting means arranged between said piston and said open end for projecting said load from said casing by movement of said piston, a portion of said piston and an interior of said casing adjacent said open end cooperating with a portion of said projecting means to provide an opening therebetween, a seal provided within said opening in contact with said portion of said piston, said portion of said casing and said portion of said projecting means for providing a sealed area thereat, whereby said projecting means is removably sealed within said open end by engagement with said seal.

2. The cartridge assembly of claim 1 wherein said portion of said casing comprises a shoulder defining an opening within said casing for receiving said projecting means therein.

3. The cartridge assembly of claim 2 wherein said shoulder and said casing are of unitary construction.

4. The cartridge assembly of claim 2 wherein said portion of said piston comprises a ridge circumscribing said piston and arranged in engagement with said shoulder.

5. The cartridge assembly of claim 4 wherein said seal comprises an O-ring provided between said shoulder and said ridge of said piston.

6. The cartridge assembly of claim 1 wherein said casing is constructed of plastic material.

7. The cartridge assembly of claim 1 further including a plug for replacing said projecting means within said open end of said casing.

8. The cartridge assembly of claim 1 wherein said rupturable closed end comprises a closure received within said rupturable closed end and stop means provided within said casing adjacent said rupturable closed end for limiting the extent of insertion of said closure within said casing by the engagement therewith.

9. A cartridge assembly for projecting a load therefrom, said cartridge assembly comprising a hollow casing having an open end and a rupturable closed end, a shoulder provided within said casing adjacent said open end, a piston movably positioned within said casing and having a ridge adjacent said shoulder, projecting means arranged between said piston and said open end for projecting said load from said casing by movement of said piston, said shoulder and said ridge cooperating with a circumferential portion of said projecting means to provide an annular opening therebetween, a seal provided within said annular opening in contact with said shoulder, said ridge and said circumferential portion of said projecting means, whereby said projecting means is removably sealed within said open end by engagement with said seal.

10. The cartridge assembly of claim 9 wherein said shoulder and said casing are of unitary construction.

11. The cartridge assembly of claim 9 wherein said ridge is arranged in engagement with said shoulder of said casing.

12. The cartridge assembly of claim 11 wherein said seal comprises an O-ring retained between said shoulder and said ridge.

13. The cartridge assembly of claim 9 further including a plug adapted for replacing said projecting means within said open end of said casing.

14. The cartridge assembly of claim 9 wherein said rupturable closed end comprises a closure received within said rupturable closed end, stop means provided within said casing adjacent said rupturable closed end for limiting the extent of insertion of said closure within said casing by the engagement therewith, and seal means for sealing said closure within said rupturable closed end.

15. A cartridge assembly for projecting a load therefrom, said cartridge assembly comprising a hollow casing having an open end and a rupturable closed end, said rupturable closed end comprising a closure received within said rupturable closed end, stop means provided within said casing adjacent said rupturable closed end for limiting the extent of insertion of said closure within said casing by the engagement therewith, and seal means for sealing said closure within said rupturable closed end; a shoulder provided within said casing adjacent said open end, said shoulder and said casing being of unitary construction; a piston movably positioned within said casing and having a ridge adjacent said open end in engagement with said shoulder; a load positioned within said casing between said piston and said rupturable closed end; projecting means removably inserted within said open end in advance of said piston for projecting said load from said casing through said rupturable closed end by movement of said piston away from said open end, said shoulder and said ridge cooperating with a circumferential portion of said projecting means to provide an annular opening therebetween; and a seal provided within said annular opening in simultaneous contact with said shoulder, said ridge and said circumferential projecting means of said piston for removably sealing said projecting means therein, said seal being compressed within said annular opening upon engagement with said projecting means.

16. The cartridge assembly of claim 15 wherein said stop means comprises a lip formed within the interior surface of said casing.

17. The cartridge assembly of claim 15 further including a seal member circumscribing said closure to provide a seal between said closure and said casing.

18. The cartridge assembly of claim 15 wherein said closure includes a projection adapted for engaging an opening provided in said casing adjacent said open end for locking said closure therein.

19. The cartridge assembly of claim 15 wherein the cross-sectional dimension of one end of said closure is smaller than the cross-sectional dimension of its other end to facilitate the insertion of said closure within said rupturable closed end of said casing.

20. The cartridge assembly of claim 15 wherein said closure includes resilient spacing means extending outwardly from one end of said closure within said casing for accommodating variations in the size of a load provided within said casing.

21. The cartridge assembly of claim 15 wherein the thickness of said hollow casing at said rupturable closed end is less than the thickness of said hollow casing inward of said stop means.

* * * * *